US005911478A

United States Patent [19]

Goodman

[11] Patent Number: 5,911,478

[45] Date of Patent: Jun. 15, 1999

[54] SLING CHAIR WITH REMOVABLE SLING

[76] Inventor: Lloyd Goodman, 7635 W. Second Ct., Hialeah, Fla. 33014

[21] Appl. No.: 09/121,207

[22] Filed: Jul. 22, 1998

[51] Int. Cl.[6] ..... A47C 7/00

[52] U.S. Cl. ..... 297/440.11; 297/452.13

[58] Field of Search ..... 297/440.11, 440.1, 297/452.18, 452.19, 452.2, 452.11, 452.12, 452.13

[56] References Cited

U.S. PATENT DOCUMENTS

| | | |
|---|---|---|
| 3,640,576 | 2/1972 | Morrison et al. . |
| 4,049,314 | 9/1977 | McGaffin . |
| 4,234,226 | 11/1980 | Colby . |
| 4,302,048 | 11/1981 | Yount . |
| 4,482,186 | 11/1984 | Gomes . |
| 4,566,731 | 1/1986 | Marchesini . |
| 4,579,383 | 4/1986 | Colby . |
| 4,588,227 | 5/1986 | Austin . |
| 4,848,843 | 7/1989 | Gibbs . |
| 5,044,690 | 9/1991 | Torrey . |
| 5,507,563 | 4/1996 | Arthur, Jr. . |
| 5,518,292 | 5/1996 | Cozzani . |
| 5,645,321 | 7/1997 | Seroldi . |
| 5,662,383 | 9/1997 | Hand . |
| 5,716,101 | 2/1998 | Frinier et al. . |
| 5,762,403 | 6/1998 | Robinson . |

*Primary Examiner*—Milton Nelson, Jr.
*Attorney, Agent, or Firm*—Lott & Friedland P.A.

[57] ABSTRACT

A sling chair with a removable sling designed to provide a simple unitary method to remove the sling material for aesthetic and/or maintenance purposes without the use of screws, bolts or hardware in general. The sling chair includes a chair frame with sling rails, including inner and outer channels, a removably attachable sling, and sling fasteners for securing the sling into the sling rails of the chair frame. The removable sling has opposite sling edges having lengthwise extending loops formed therein. A flexible sling rod extends throughout the entire length of the loops. The sling rod is smaller than the inner channels contained within the sling rails to allow insertion of the sling rod into the inner channels thereby removably attaching the sling to the sling rails forming the seatrest and backrest of the chair. The sling fasteners, are attached to the opposite ends of the sling, once the sling is inserted into the inner channels of the sling edges and pulled downwards towards the front seat of the chair frame. The sling is made of a web material strong enough to support the tensile forces created by a person sitting on the sling chair.

6 Claims, 4 Drawing Sheets

SLING CHAIR WITH REMOVABLE SLING

FIELD OF INVENTION

The present invention relates generally to sling chairs of the type having a seatrest and a backrest made of mesh or fabric material, designed especially for this purpose. The material forms a sling across a metal skeleton frame of the chair. In particular, the invention relates to a sling chair with a removable sling without the use of screws, bolts or hardware in general.

BACKGROUND OF THE INVENTION

This invention is directed to an improved occasional chair, and more particularly, to a sling chair with a removable sling. Typically, sling chairs have a frame that is generally made of extruded metal tubing that is assembled into a rigid frame that defines the sides of a seating area. A sling rail, sections of tubing having channels formed therein for insertion of the sling, are positioned along the sides of the seating area, generally within the exterior confines of the frame. Usually, manufacturers of sling chairs first weld one sling rail to one side of the frame, insert the sling into the welded sling rail and the opposite loose sling and finally attach the loose sling rail to the opposite side of the frame. Commonly, the use of rivnuts and bolts are used to fasten the opposite loose sling rail to the frame thus tightening the sling material in place. In sling chairs, the seat and backrest are formed by a relatively heavy web of material that is tautly stretched across the lateral sides of the frame. The only way to remove the web of material from the chair frame is to dismantle the chair frame.

An object of this invention is to provide a sling chair with an easily removable sling for aesthetic and/or maintenance purposes while improving the strength without altering the basic design of the chair frame. The sling chair is completely welded together and eliminates mechanical features.

Another object of this invention is to provide a sling chair that is comfortable, adaptable to all body shapes and relatively inexpensive.

Another object of this invention is to provide a sling chair with additional seat supports to sustain the tensile forces created from a person sitting on the sling chair.

Previous attempts have been made to provide an attachment means for a removable chair covering to provide easy maintenance of the chair covering and/or replacement of the chair covering for aesthetic reasons such as described in U.S. Pat. No. 5,662,383 to Hand ('383 patent); U.S. Pat. No. 4,302,048 to Yount ('048 patent); U.S. Pat. No. 5,518,292 to Cozzani ('292 patent); U.S. Pat. No. 4,252,367 to Vanderminden ('367 patent) and U.S. Pat. No. 5,318,348 to Hess ('348 patent); all of which are incorporated herein by reference.

The '383 patent discloses an attachment means for attachment of cloth to a furniture frame, particularly to a chair assembly including a frame defining a channel and a deflectable wall, a retainer receivable by the channels and engageable with the deflectable wall and a web of fabric located in said channel and engageable with the retainer. The chair frame has an attachment means for the backrest fabric and an attachments means for the seatrest fabric.

The '048 patent discloses a collapsible chair made primarily of canvas and hardwood made up of two sides each having an arm, a front and back leg, and a bottom connecting member between the front and the back legs. Canvas seat and back are mounted in grooves in each of the two sides with stretcher means to enable assembly of the sides, seat and back means to be a very comfortable occasional chair.

The '292 patent describes a fixing device for securing a cover to a seat. The device comprises a support and a plurality of elastic fastenings locked in the support, wherein the support comprises more locking apertures than the device has elastic fastenings. The support is sewn onto the covering, the fastenings are locked in the support and after positioning the covering on the seat, the hooks of the fastenings are engaged on the seat.

The '367 patent describes a sling chair in which the sling is secured in a front cross-bar which is pivotally mounted in a suspended matter at the front of the chair to accommodate the various positions of an occupant. A flexible plate is also secured to the front crossbar under the sling to increase the contact area with an occupant's legs and thus spread the load.

The '348 patent describes a sling chair with a webbed material stretched tautly across a rigid skeletal frame. The chair has a skeletal frame and a pliable seat and backrest having a first and second superposed and interconnected fabrics. The first and second fabrics have looped fabric portions that define opposite side edges of the fabrics. Each of the looped fabric portions in the first fabric contains an elongate flexible member. The chair frame include lengthwise extending passageways and longitudinal slots for receiving the looped fabric portions of the first fabric and the elongate flexible members to secure the seat and backrest to the chair frame.

None of the devices mentioned above describe a sling chair with a removable sling comprising a simple one-step method of attaching the sling to the chair. In particular, the '348, '048 and '367 patents describe a sling chair with a non-removable sling. In order to remove the sling, the chair frame must be dismantled. The chair described in this patent is meant to provide an easy method for removing the sling from the chair for either maintenance purposes or replacement of the sling for aesthetic purposes without the need of mechanical fasteners.

The '092 patent describes a device for fastening a seat cover to a seat and comprises a support and a plurality of elastic fastenings locked in the support, wherein the support comprises more locking apertures than the device has elastic fastenings. In order to use this device, the support must be sewn onto the covering, the fastenings must be locked in the support and after positioning the covering on the seat, the hooks of the fastenings must be engaged on the seat. Alternatively, the present invention discloses a one-step method for releasably fixing a sling to a chair frame, without the need of sewing the support onto the covering or placing fastenings onto the chair frame.

Finally, the '383 patent describes an attachment means for attaching a cloth to a furniture frame. The '383 patent describes attachment means in the frame of the chair for attaching a seat rest fabric and attaching a backrest fabric. The attachment means comprises a frame defining a channel and a deflectable wall, a retainer receivable by the channels and engageable with the deflectable wall and a web of fabric located in said channel and engageable with the retainer. The removable attachment means disclosed in the present invention comprises insertion of a unitary removable sling into inner channels formed in sling rails included in the chair frame, sliding the sling downwards until the sling forms a backrest and seatrest covering the chair frame and placing sling fasteners for securing said sling into place. Removal of the sling is accomplished by removing the sling fasteners and pulling the sling upwards as the sling edges slide out from the inner channels contained within the sling rails of the chair frame.

Consequently, there is a need in the art for a sling chair with a removable sling, which is easily and efficiently removably attachable to the frame of the chair.

There is a further need in the art for a sling chair with a removable sling, which can be detached from the chair frame for cleaning and repair purposes.

There is a further need in the art for the removably attachable sling to maintain the resistance of slings utilized in previous sling chairs, namely those slings which are permanently attached to their frames.

There is a further need in the art for a sling chair with a removable sling which eliminates mechanical fasteners in the installation and removal of sling materials.

SUMMARY OF THE INVENTION

The above and other objects of the invention are achieved in the embodiments described herein by the provision of a sling chair having a chair frame with sling rails, a removable sling, a removable attachment means for releasably fixing the sling to the sling rails, and sling fasteners for securing the sling into the sling rails of the chair frame. The chair frame can be configured as a chaise lounge, ottoman, recliner, or other similar indoor and outdoor sling furniture. The chair frame includes opposite side members, each side member having a front and a rear leg, a lateral seat support, an armrest, a side stretcher and an upper backrest support. The side members are interconnected by a front seat support and a rear seat support, a front and rear stretcher and a backrest stretcher. A pair of horizontal seat supports interconnect the lateral seat supports to provide additional support. The sling rails have lengthwise extending inner and outer channels therein. The sling is made of a web material strong enough to support the tensile forces created by a person sitting on the sling chair. Opposite sling edges have lengthwise loops, encasing a flexible sling rod of a size smaller than the inner channels within the sling rails. Removable attachment of the sling onto the chair frame comprises insertion of the sling edges into the inner channels of the sling rails, pulling the sling downwards until it covers the chair frame forming a backrest and a seatrest. The sling fasteners removably attach to the sling and secure the sling into place at the opposite bottom ends of the sling.

BRIEF DESCRIPTION OF THE DRAWINGS

The foregoing and other objects, advantages and features of the invention, and the manner in which the same are accomplished, will become more readily apparent upon consideration of the following detailed description of the invention taken in conjunction with the accompanying drawings which illustrate preferred and exemplary embodiments, and wherein.

DESCRIPTION OF THE PREFERRED EMBODIMENTS

Figure 1:
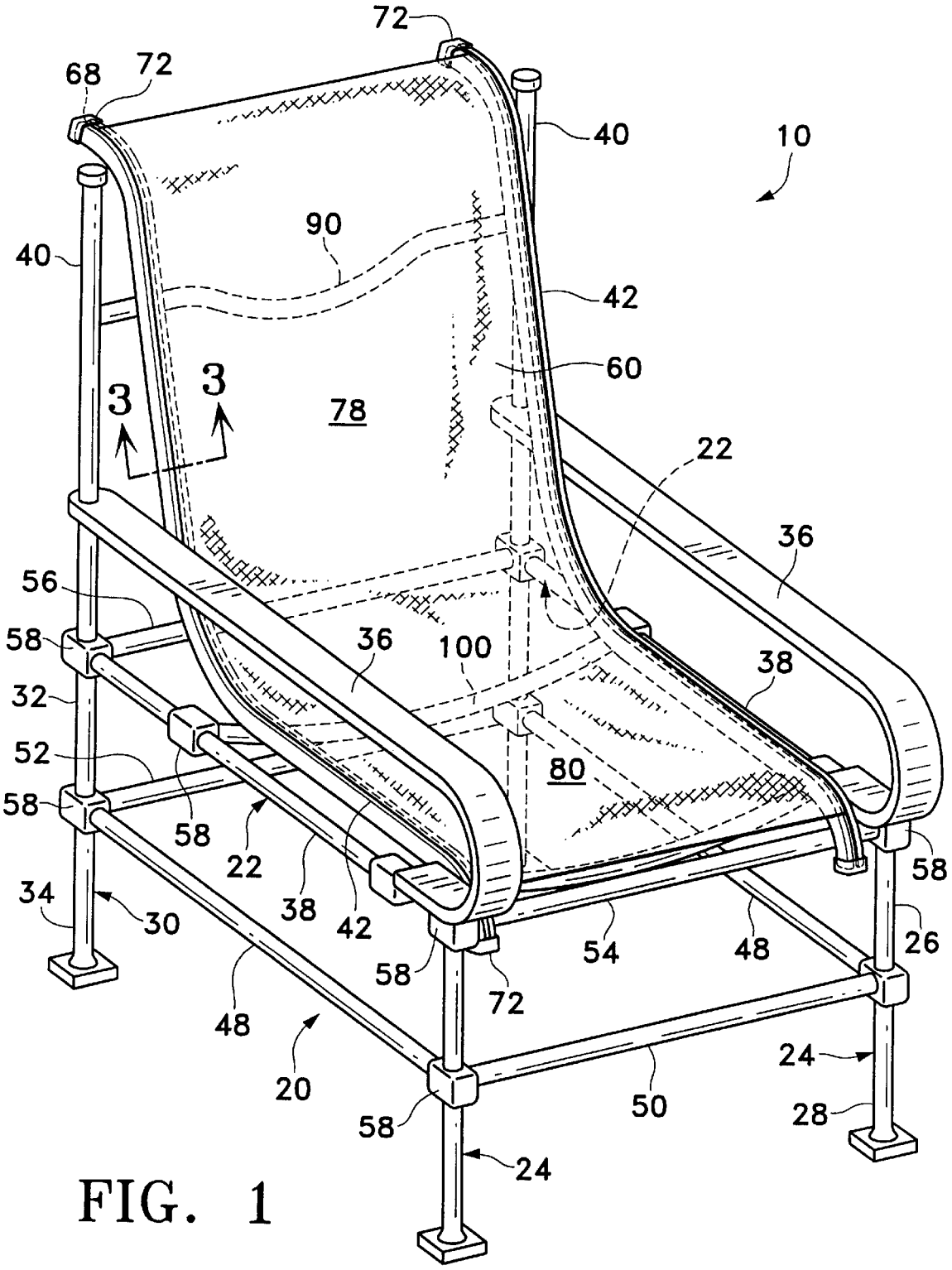
FIG. 1 is a perspective view of one preferred embodiment of a sling chair with able sling made in accordance with the present invention.

Referring now to the drawings, FIG. 1 illustrates a sling chair with a removable sling designated generally at 10 which is made in accordance with the present invention. The sling chair 10 has a chair frame 20 formed of rigid materials, and a removable sling 60 forming a backrest 78 and a seatrest 80. In a preferred embodiment, the chair frame 20 is formed of extruded metal tubing such as aluminum which is bent and welded or otherwise joined to form the chair frame 20. As used in this description and the appended claims, the chair frame can be configured as a chaise lounge, ottoman, recliner, or other similar outdoor or indoor sling furniture.

Figure 2:
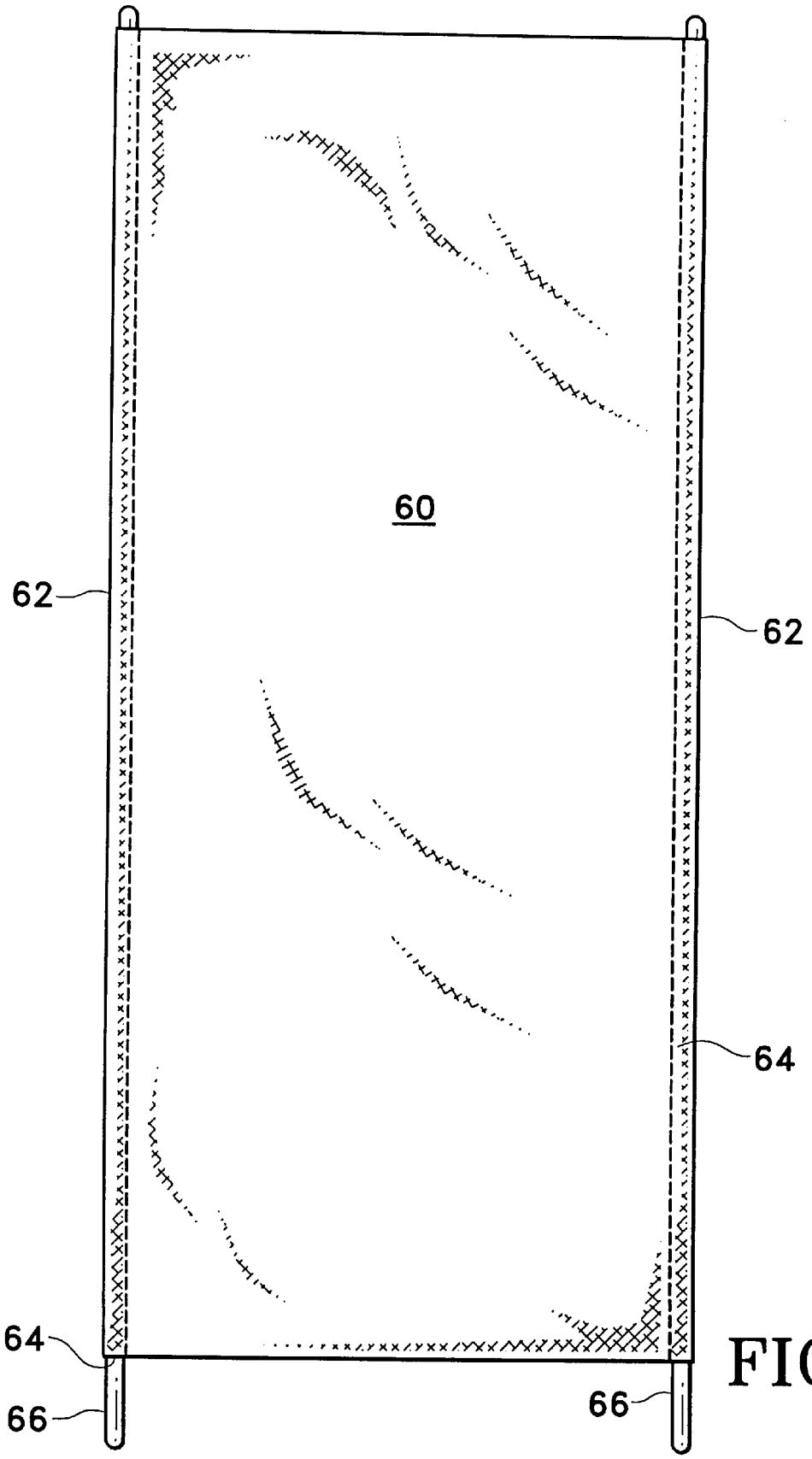
FIG. 2 is a perspective view of the sling made in accordance with the present invention which is not attached to the chair frame.

The chair frame 20 includes opposite side members 22, which are identical to each other and that define front legs 24 with a top end 26 and a bottom end 28, rear legs 30 with a top end 32 and a bottom end 34, armrests 36, lateral seat supports 38, upper backrest supports 40, and sling rails 42 having lengthwise extending outer and inner channels 44 and 46 formed therein, as shown in FIG. 2. The side members 22 also include side stretchers 48 which interconnect the rear legs 30 and front legs 28 together, at a midway point between the top end and bottom end of each leg, each side stretcher 48 positioned parallel and below the lateral seat supports 38.

The side members 22 are interconnected by a bottom front stretcher and a bottom rear stretcher, 50 and 52 respectively, by a front and a rear seat support, 54 and 56, respectively, and by a backrest stretcher 90. As shown in FIG. 1, the front seat support 54 interconnects the opposite top ends of the front legs 26, and the rear seat support 56 interconnects the opposite top ends of the rear legs 32, to define a seatrest 80 between the lateral seat supports 38. The backrest stretcher 90 interconnects the side members between the upper back supports 40. A pair of horizontal seat supports 100 interconnect the opposite lateral seat supports to provide additional support to sustain the tensile forces created when a person is sitting on the chair. Caps 58 are positioned to overlie and cover each end of the front and rear seat support 54 and 56, each end of the bottom front and rear stretchers 50 and 52, and each end of the horizontal seat supports 100.

As shown in FIGS. 1 and 2 the removable sling 60, which forms the seatrest 80 and backrest 78, is formed by a unitary web material that is removably attached to the sling rails 42. The sling 60 is preferably made of a material that is capable of supporting the tensile forces which result from a person sitting on the chair. Sling materials consist of vinyl coated polyester fabric and acrylic fabrics which are specifically made for this purpose and/or use.

As shown in FIG. 2, the removable sling 60 is of a size forming the seatrest and backrest of the chair. The removable sling 60 has opposite sling edges 62 having lengthwise extending loops 64 formed therein. A flexible sling rod 66 extends throughout the entire length of the loops 64.

Figure 3:
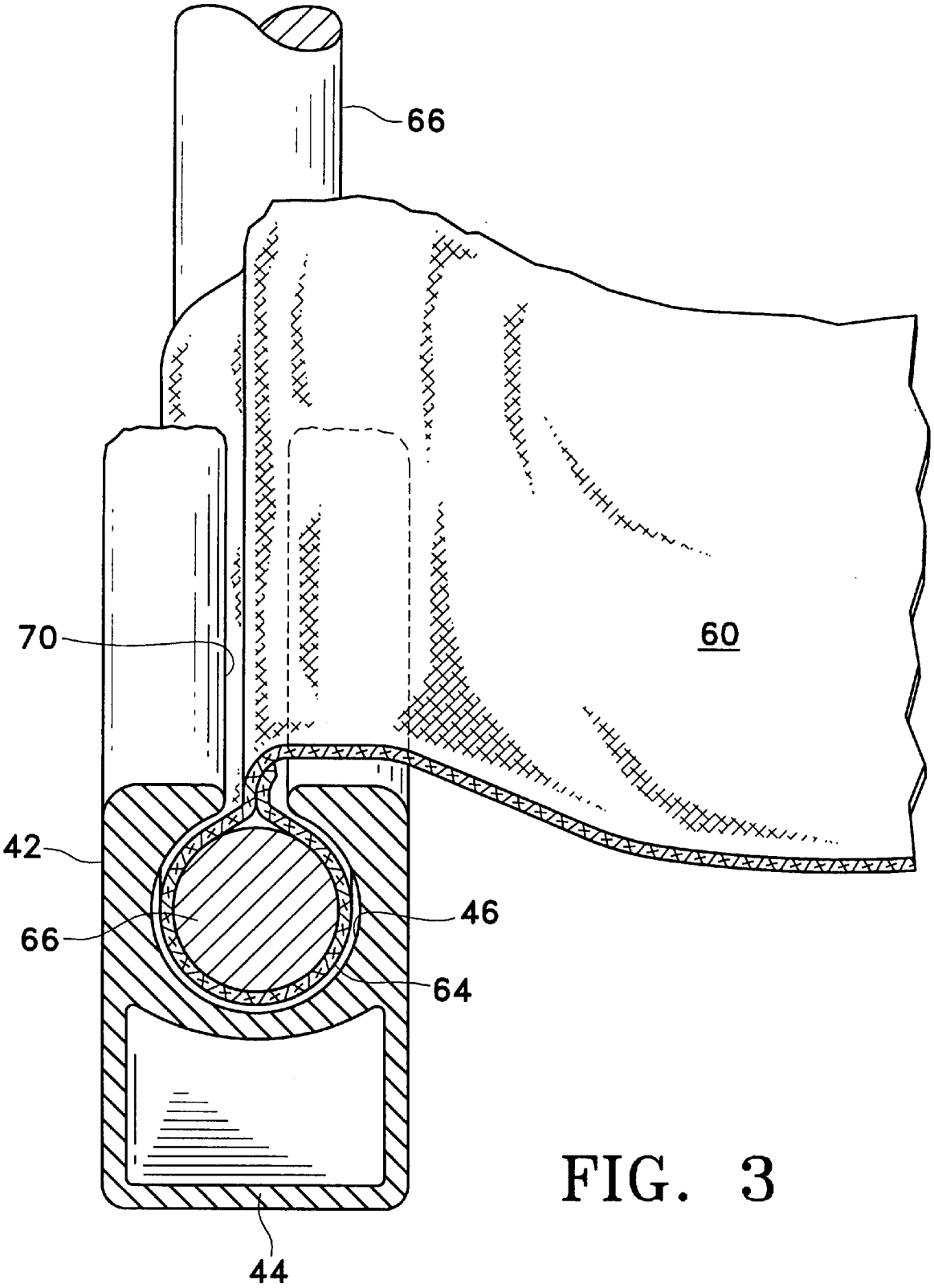
FIG. 3 is an enlarged sectional view along the line 3—3 of FIG. 1.

As shown in FIG. 3, the sling rod 66 is smaller than the inner channels 46 contained within the sling rails 42, to allow insertion the sling rod 66 into the inner channels 46 thereby removably attaching the sling 60 to the sling rails 42, forming the seatrest 80 and backrest 78 of the chair.

Figure 4:
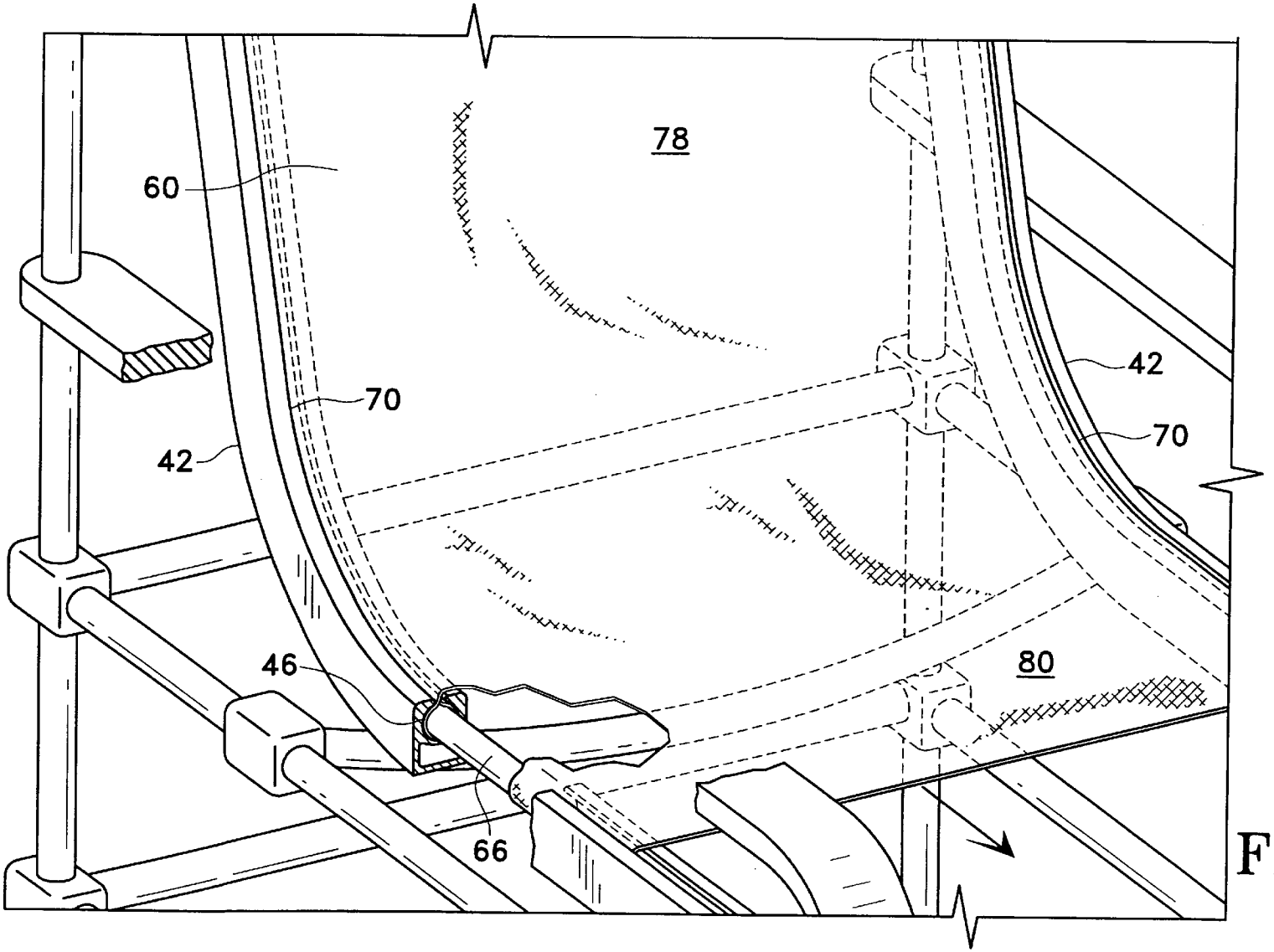
FIG. 4 is an enlarged view showing the removable attachment means of the sling to the chair frame.

As shown in FIG. 3, and 4, the means for removably attaching the sling 60 to the sling rails 42 is relatively simple. Each inner channel 46 has an open end 68 and a slit along the entire length of the inner channel 70. The sling rods 66 are "slid" into the corresponding open ended inner channels 68, within the sling rails 42. Once the sling rods 66 are placed into the inner channels 46, the sling 60 is pulled downwards towards the seat rest 80, sliding the sling rod through the inner channels 46, until the sling edges 62 contact the front seat support 54. As seen in FIG. 4, the slit 70 allows the sling 60 to slide down and cover the chair frame thereby forming a backrest and seatrest. A sling fastener 72 is attached to the opposite bottom ends of the sling 68 to secure the sling 60 to the sling rails 42.

What is claimed is:

1. A sling chair assembly comprising:

A a chair frame having sling rails, said sling rails including inner and outer channels having a lengthwise slit along the length of said inner channels;

a pair of opposite side members including, a front leg having a top end and a bottom end, a rear leg having a top end and bottom end, an arm rest, a lateral seat support, an upper backrest support, a side stretcher, said stretcher interconnecting said front leg and said back leg at a midway point between said top end and bottom end of said front and back leg;

a front seat support interconnecting said top ends of said front legs and a back seat support interconnecting said top ends of said back legs, forming a seatrest;

a bottom front stretcher interconnecting said opposite front legs and a bottom rear stretcher interconnecting said opposite rear legs;

a backrest stretcher interconnecting said upper backrest supports;

a pair of horizontal seat supports interconnecting said opposite lateral seat supports to provide additional support;

B a sling comprising a web of material; and

C a means for removably attaching said sling to said sling rails.

2. The sling chair assembly set forth in claim 1, wherein said removable attachment means comprises a sling fastener attached to opposite bottom ends of said sling, whereby each sling fastener removably secures said opposite sling edges to the inner channels of said sling rails at the opposite bottom ends of said sling, once said opposite sling edges are inserted into said sling rails and pulled downwards towards the front seat support, thereby forming a backrest and a seatrest for said chair frame.

3. The sling chair assembly as set forth in claim 1, wherein said chair frame is a chair.

4. The sling chair assembly as set forth in claim 1, wherein said chair frame is an ottoman.

5. The sling chair assembly as set forth in claim 1, wherein said chair frame is a chaise lounge.

6. The sling chair assembly as set forth in claim 1, wherein said chair frame is a recliner.

* * * * *